United States Patent [19]

Dillingham

[11] Patent Number: 4,569,450

[45] Date of Patent: Feb. 11, 1986

[54] NECKTIE STORAGE RACK WITH FOLDING HANGER MEMBERS

[76] Inventor: Richard F. Dillingham, 4309 Shady Hill, Dallas, Tex. 75229

[21] Appl. No.: 526,348

[22] Filed: Aug. 24, 1983

[51] Int. Cl.[4] ..... A47F 5/08

[52] U.S. Cl. ..... 211/96; 211/104

[58] Field of Search ..... 211/96, 105.1, 104, 211/168, 94, 87, 162

[56] References Cited

U.S. PATENT DOCUMENTS

| | | | |
|---|---|---|---|
| 2,061,156 | 11/1936 | Humphrey | 211/96 |
| 2,285,632 | 6/1942 | Urbain | 211/60 R |
| 2,334,740 | 11/1943 | Acosta | 211/104 |
| 2,409,570 | 10/1946 | Kramer | 211/96 |
| 2,473,029 | 6/1949 | Kovacs | 211/106 X |
| 2,499,159 | 2/1950 | Pestyner | 211/96 |
| 2,515,293 | 7/1950 | Carter | 211/96 X |
| 2,724,510 | 11/1955 | Williams | 211/96 X |
| 3,430,905 | 3/1969 | Pepe | 248/300 X |
| 3,515,284 | 6/1970 | Taylor | 211/94 X |
| 4,194,636 | 3/1980 | Byram et al. | 211/94 X |

OTHER PUBLICATIONS

Hollywood #400 Tie Rack.

*Primary Examiner*—Robert W. Gibson, Jr.

*Attorney, Agent, or Firm*—Hubbard, Thurman, Turner & Tucker

[57] ABSTRACT

An apparel support device particularly adapted for hanging a plurality of neckties comprising a rectangular base member having a longitudinal channel formed therein and including opposed longitudinal grooves for receiving side flanges of a channel shaped hanger support member. A sheet metal hanger support member has opposed end flanges which are bent into a plane normal to the web of the hanger support member to provide for retaining the hanger support member on the base member and to provide limited movement of the hanger support member with respect to the base member to align cooperating fastener clearance holes on the respective members. The clearance holes in the hanger support member are in a conical boss formed by displacing portions of the web of the support member. Formed wire hanger members include a distal end formed into a circular loop having equal circular portions extending on opposite sides of the shank portion of the hanger member.

3 Claims, 5 Drawing Figures

NECKTIE STORAGE RACK WITH FOLDING HANGER MEMBERS

BACKGROUND OF THE INVENTION

1. Field of the Invention

The present invention pertains to an apparel storage device comprising a support structure for a plurality of folding hanger members particularly adapted for storing neckties or similar apparel articles.

2. Background

One particularly advantageous type of apparel storage device or rack, suited for storing a plurality of neckties, is characterized by a base member adapted to be mounted on a wall or other support structure and on which a plurality of laterally projecting hanger members are supported for pivotal movement between an extending position wherein an article of apparel may be supported on or removed from the rack and a folded position wherein the rack occupies a minimum amount of space on a closet wall or door, for example. This type of apparel storage device is also characterized by a hanger support member which is mounted on the base member and covers a channel formed in the base member and providing clearance for movement of linkage interconnecting the respective hanger bars.

This type of device must be manufactured at reasonable cost in order to be a marketable item and at the same time be constructed to have a pleasing appearance, since it is often considered an impulse purchase type of product. On the other hand, the device must be functionally superior and easy to install. To this end certain improvements have been considered desirable but have heretofore been unrealized prior to the development of the present invention.

SUMMARY OF THE INVENTION

The present invention provides an improved apparel storage device comprising a base member adapted to be mounted on a support surface. The base member is configured to support, in conjunction with a hanger support member, a plurality of laterally projecting separate hanger bars particularly adapted for supporting and storing articles such as neckties and the like.

In accordance with one aspect of the present invention an improved necktie supporting and storage device is provided by the aforementioned base member which is configured to be secured to a channel shaped hanger support member by opposed flanges on the hanger support member which are fitted in opposed longitudinal grooves formed in the base member and wherein the hanger support member is retained on the base member by opposed end flanges on the hanger support member which are engageable with the base member. The configuration of the hanger support member with the opposed end flanges which are bent into position to retain the support member in assembly with the base member eliminates the need for separate fasteners for retaining the two members in assembly with each other and facilitates the ease with which the hanger bars may be inserted in or removed from the rack assembly, if needed.

In accordance with another aspect of the present invention the base member and the hanger support member are provided with cooperating fastener clearance holes, and the hanger support member is mounted on the base member for limited movement to facilitate alignment of the clearance holes during mounting of the support device on a wall or other support structure.

In accordance with still another aspect of the present invention the hanger support member is provided with frusto-conical shaped bosses formed by displacing the metal structure of the hanger support member around the fastener clearance holes to strengthen the hanger support member in the vicinity of the fastener clearance holes to prevent deflection of the support member when it is secured against a support surface by screws or nails.

In accordance with yet a further aspect of the present invention there is provided an apparel support device having a plurality of interconnected formed wire hanger members wherein one end of each of the hanger members is bent back on itself to form a circular loop having a diametral line coincident with the longitudinal axis of the shank of the hanger member so that the hanger member may be used in a first position and a second inverted position with equal ability to retain an article of apparel supported on the hanger member.

The foregoing advantages and superior features of the present invention as well as other unique aspects thereof will be further appreciated by those skilled in the art upon reading the detailed description which follows in conjunction with the drawing.

DESCRIPTION OF THE PREFERRED EMBODIMENT

Figure 1:
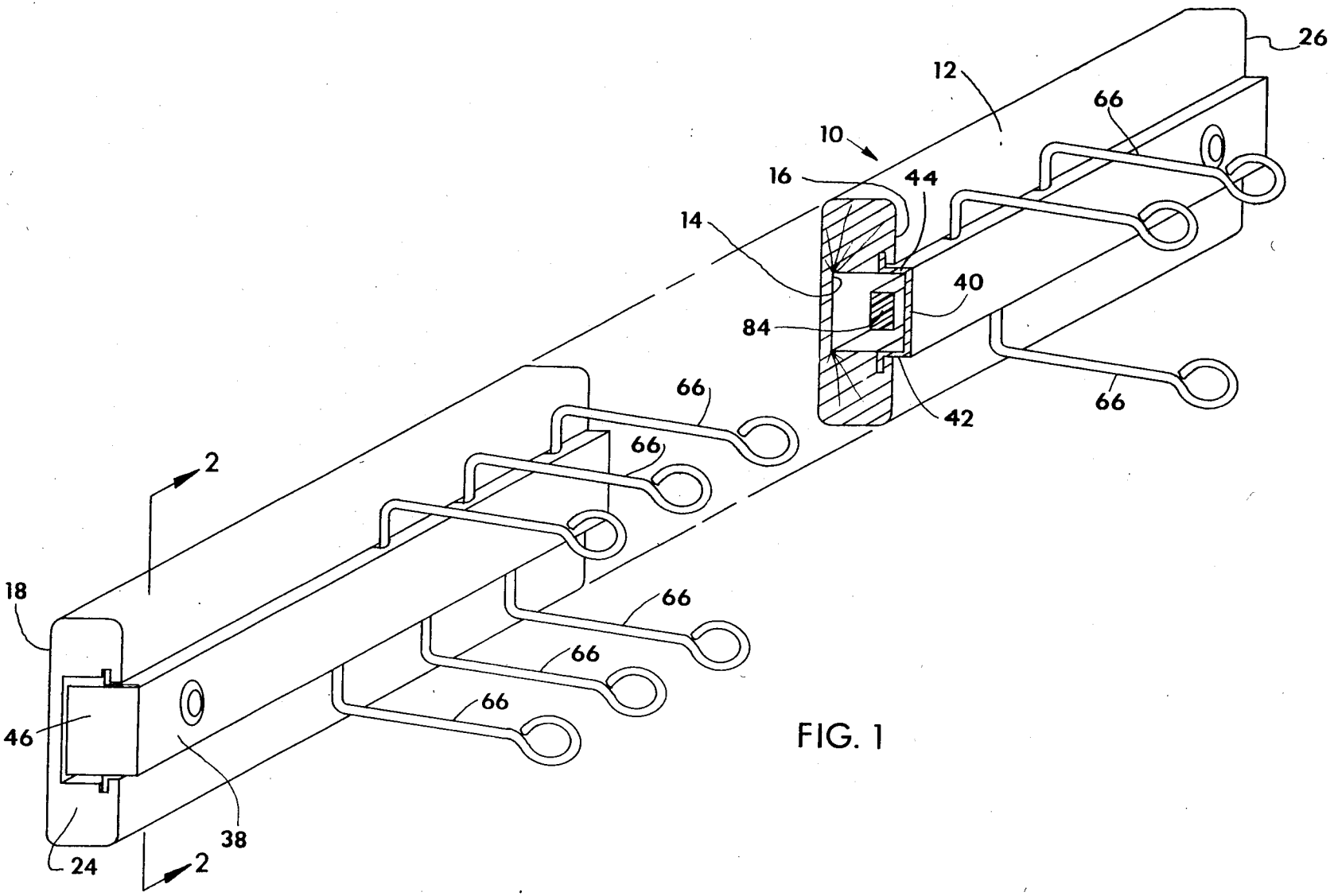
FIG. 1 is a perspective view of the apparel support device of the present invention.

In the description which follows like parts are marked throughout the specification and drawing with the same reference numerals, respectively. The drawing is not necessarily to scale and certain features of the invention may be shown exaggerated in scale in the interest of clarity and conciseness.

Figure 3:
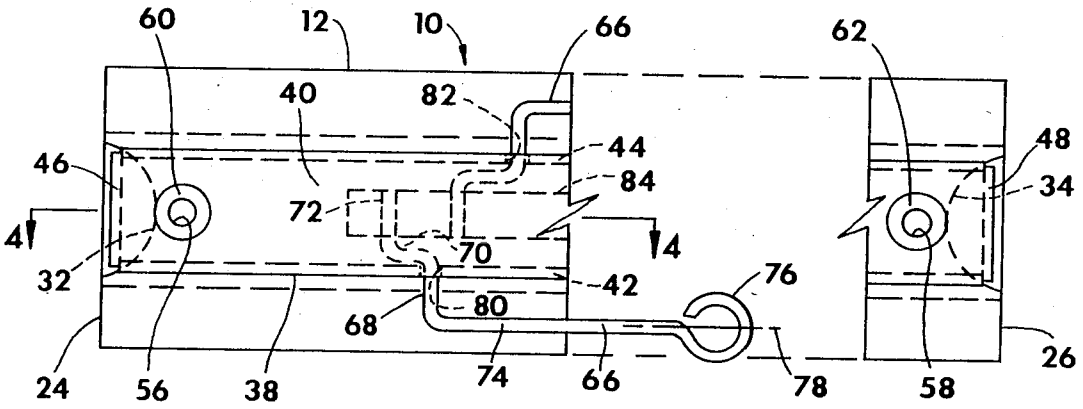
FIG. 3 is a plan view of the device illustrated in FIGS. 1 and 2.
Figure 4:
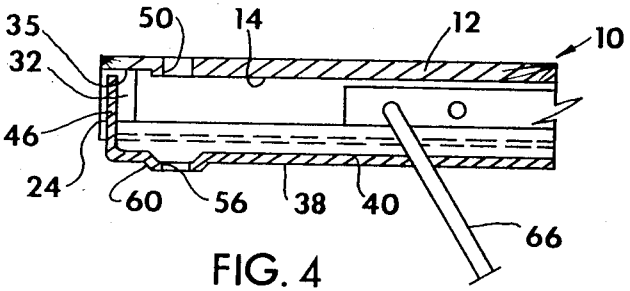
FIG. 4 is a detail section view taken along the line 4—4 of FIG. 3.
Figure 2:
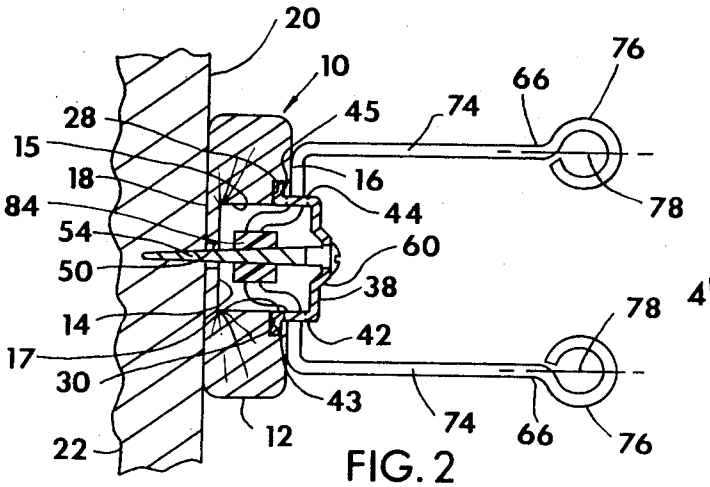
FIG. 2 is a transverse section view taken along the line 2—2 of FIG. 1.

Referring to FIGS. 1 through 3, in particular, the present invention pertains to an apparel support device, generally designated by the numeral 10, and comprising means for supporting a plurality of neckties or the like. The support device 10 includes an elongated base member 12 which may be formed of a decorative material such as furniture grade wood or the like and having a generally rectangular cross-section. The base member 12 is provided with an elongated channel 14 formed therein and opening to one face 16 of the base member. The opposite face 18 is adapted for supporting the apparel device against a support surface 20 comprising a closet wall or the like 22, FIG. 2. The channel 14 opens to opposite end faces 24 and 26 of the base member 12 and includes a pair of opposed longitudinal grooves 28 and 30 which are formed in the respective opposed sidewalls of the channel 14. The base member 12 is also provided with relieved surfaces defined by arcuate recesses 32 and 34, respectively, which are formed at the intersection of the channel 14 with the opposed end faces 24 and 26. As shown by way of example in FIG. 4, the base 35 of the recess 32 is formed slightly deeper than the channel 14. The recesses 32 and 34 may be formed by suitable cutting tools such as an end mill or a router type tool plunged into the ends of the base member 12. The channel 14, including the grooves 28 and 30, may also be formed by a router type cutter or the like.

The support device 10 also includes a formed sheet metal element comprising a hanger support member 38 which is substantially channel shaped and has a base or web portion 40, opposed side flanges 42 and 44 and opposed end flanges 46 and 48, see FIG. 3, in particular. The distal edges of each of the flanges 42 and 44 are bent at 43 and 45, respectively, to provide flange portions which are insertable in the respective grooves 30 and 28 for retaining the support member 38 on the base member 12. The end flanges 46 and 48 are formed by bending opposed end portions of the web 40 substantially perpendicular of the plane of the web and at least one of the end flanges is folded or bent into the position shown in FIG. 3 after the hanger support member 38 is assembled on the base member 12 by sliding the flange portions 43 and 45 into the respective grooves on the base member from one end thereof. Upon assembly of the hanger support member 38 on the base member 12 as described, the end flange 46 or 48 which is previously unbent is then folded into the flange forming position, as indicated by way of example in FIG. 4 for the flange 46, to retain the hanger support member on the base member.

Thanks to the provision of the arcuate recesses 32 and 34, the respective flanges 46 and 48 may be formed to lie coplanar with the respective end faces 24 and 26, respectively, or in respective planes directly adjacent and between the planes of the end faces 24 and 26. Moreover, the recesses 32 and 34 provide some clearance for longitudinal limited movement of the hanger support member 38 with respect to the base member 12 until the respective flanges 46 and 48 engage the base member wall surfaces delimiting the respective recesses 32 and 34. In this way limited longitudinal movement of the hanger support member 38 with respect to the base member 12 may be obtained, and the hanger support member may be conveniently assembled with respect to the base member without the use of separate fastener elements, adhesives or other assembly operations.

The base member 12 is also provided with a pair of spaced apart clearance holes 50 and 52 which are adapted to provide clearance for suitable threaded fasteners such as elongated wood screws 54, one shown by way of example in FIG. 2, for mounting the device 10 on the support surface 20. The hanger support member 38 is also provided with fastener clearance holes 56 and 58, FIG. 3, which are spaced apart substantially the same distance as the clearance holes 50 and 52. The clearances holes 56 and 58 are each formed in generally frusto-conical shaped bosses 60 and 62 formed in the web 40 of the hanger support member, which bosses project from plane of the web portion 40 outwardly away from the channel 14. The bosses 60 and 62 are preferably formed by a coining, embossing or similar metal displacing operation performed on the hanger support member 38 at the time that the support member 38 is stamped or otherwise formed from sheet metal stock, for example. The provision of the frusto-conical bosses 60 and 62 substantially eliminate any tendency for the web portion 40 of the hanger support member to be displaced or dimpled inwardly toward the channel 14 as a result of overtightening the mounting screws 54. Moreover, in accordance with a particularly advantages aspect of the present invention the hanger support member 38 may be moved slightly with respect to the base member 12 to align the clearance holes 56 and 58 with their counterpart holes 50 and 52 in the base member to facilitate insertion of the fasteners at the time of mounting the device 10 on a support surface.

The apparel storage device 10 is further characterized by a plurality of formed wire hanger members, each generally designated by the numeral 66. The hanger members 66 are each provided with a crank portion formed by sections 68, 70, and 72 which are bent at right angles with respect to each other as shown by way of example in FIG. 3. The hanger members 66 are each further characterized by a shank portion 74 extending between the crank portion and having a distal end portion bent back on itself in a circular loop 76. The loop end portion 76 is coplanar with the crank portion of hanger member 66 and bent so that a diametral line 78, FIGS. 2 and 3, is formed which is coincident with the longitudinal axis of the shank portion 74. The loop end portion 76 is provided to retain articles such as neckties, not shown, on the shank portion 74 to prevent them from falling off of the respective hanger members. In this regard, it is particularly advantages to provide the loop end portion 76 with equal laterally projecting portions on each side of the shank 74 by forming the loop to have a diametral line 78 as described. In this way, the hanger members 66 may be used in mutually inverted positions, as indicated in FIGS. 1, 2 and 3, and have equal support and retention capabilities when used in either position.

Figure 5:
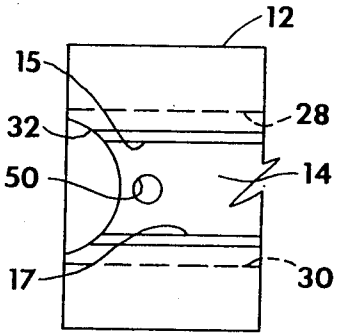
FIG. 5 is a detail plan view of a portion of the base member of the support device.

As indicated in FIGS. 2 and 3, the crank portions of the respective hanger members 66 extend through the opposed flanges 42 and 44 which are provided with spaced apart bearing bores or slots 80 and 82, respectively, as indicated by way of example in FIG. 3, and through which the crank sections 68 extend. The respective distal ends 72 extend into cooperating bores formed in a link 84 which interconnects all of the hanger members 66 so that the hanger members may be moved in unison between a folded position, indicated in FIG. 3, to an extended position indicated in FIGS. 1 and 2, or to any intermediate position as indicated by way of example in FIG. 4. In this way, the hanger members 66 may be folded toward the wall surface on which the device 10 is mounted to occupy less space and then may be moved into an extended position so that an article of apparel may be hung on or removed from any one of the hanger members. The channel 14 is preferably dimensioned so that the sidewalls 15 and 17, FIGS. 2 and 5, are spaced apart sufficiently to permit movement of the link 84 and the crank portions of the members 66 within the channel 14, but also to retain the hanger members 66 in assembly with the link 84.

As previously mentioned the apparel support device 10 is preferably made of decorative wood and metal parts wherein the base member 12 may be formed of furniture grade woods and may be easily fabricated by routing the channel 14 in one operation and end milling or routing the member to form the respective arcuate recesses 32 and 34. The hanger support member 38 is also conveniently fabricated of a decorative and malleable metal such as brass which may be easily cut to shape and coined to form the frusto-conical bosses 60 and 62 in one operation, followed by a folding operation to form the opposed flanges 42 and 44. The formed wire hanger members 66 may also be fabricated using conventional wire forming techniques. The link 84 may be made of any suitable engineering material such as molded or extruded plastic.

Prior to assembly of the component parts making up of the apparel support device 10, one or the other of the flanges 46 and 48 is left unformed and essentially coplanar with the web 40. Upon assembly of the respective wire form hanger members 66 by extending the crank portions through the bearing slots 80 and 82 each of the respective hanger members 66 is assembled by inserting the distal end sections 72 into cooperating bores formed in the link 84. The assembly of the hanger support member 38, together with the assembled hanger members 66 and link 84 is then mounted on the base member 12 by sliding the hanger support member into the cooperating grooves 28 and 30 from one end or the other of the base member.

Upon assembly of the hanger support member 38 to the base member 12 the one flange 46 or 48 which was left unbent is then folded into position to retain the hanger support member in assembly with the base member but to provide limited movement of the hanger support member with respect to the base member to allow alignment of the cooperating sets of mounting holes 50, 56 and 52, 58. Of course, if it is necessary to disassemble the device 10 one or the other of the end flanges 46 and 48 may be unbent to permit removal of the hanger support member 38 from the base member 12.

Although a preferred embodiment of the present invention has been described in detail herein those skilled in the art will appreciate that various substitutions and modifications may be made to the specific embodiment described without departing from the scope and spirit of the invention as recited in the appended claims.

What I claim is:

1. An apparel support and storage device particularly adapted for storing articles such as neckties and the like, said device including:

an elongated base member having a longitudinal channel opening to one side and to opposite ends of said base member, said channel being defined in part by opposed sidewalls and elongated parallel opposed grooves formed in respective ones of said sidewalls and opening to said channel and to said opposite ends;

a plurality of hanger members each having a shank portion and an integral crank end portion connected to a link at spaced apart intervals on said link;

an elongated channel shaped hanger support member having a web portion and spaced apart parallel side flanges connected to said web portion and supported at their distal ends in said grooves, respectively, and crank support means on said flanges for supporting and retaining said hanger members connected to said link wherein said link and said crank portions are disposed in said channel and retained in assembly by and between the sidewalls of said channel, cooperating pairs of fastener receiving holes formed spaced apart in said base member and said web portion, respectively, for receiving screw fasteners for mounting said device on a support surface, said support member including opposed end flanges connected to said web portion and engageable with said base member at opposite ends of said channel and comprising means for retaining said support member in assembly with said base member and for limited movement relative to said base member for aligning respective ones of said fastener receiving holes in said support member and said base member.

2. The device set forth in claim 1 wherein:

said support member comprises a sheet metal part, said flanges being formed by bending said web portion along two parallel lines to form said side flanges, and two parallel lines to form said end flanges, respectively, at least one of said end flanges initially remaining coplanar with said web portion to permit assembly of said support member to said base member, said one end flange being bendable with respect to said web portion for retaining said support member on said base member.

3. An apparel support and storage device particularly adapted for storing articles such as neckties and the like, said device including an elongated base member including a portion forming a longitudinal channel opening to one face of said base member, an elongated hanger support member including a web portion and means for supporting said hanger support member on said base member overlying said channel, opposed end flange portions formed on said hanger support member and engageable with said base member for retaining said hanger support member on said base member for limited movement of said hanger support member relative to said base member, cooperating clearance holes in said base member and said web portion for receiving mounting fasteners for supporting said device on a wall, generally conical shaped bosses formed by displacing a portion of said web portion around said clearance holes to reinforce said web portion against deflection upon tightening the head of a fastener against said web portion, and opposed recesses formed in respective ones of opposite end faces of said base member and intersecting said channel to provide clearance for said end flange portions when said hanger support member is disposed on said base member and to provide for engagement between said base member and said end flange portions, respectively, whereby said end flange portions retain said hanger support member in assembly with said base member, said recesses further providing limited movement of said hanger support member relative to said base member to provide for alignment of said clearance holes in said base member and said hanger support member to facilitate insertion of said fasteners through said clearance holes, respectively, and engageable with said bosses upon securing said device to a surface with said fasteners.

* * * * *